US005310098A

United States Patent [19]

Edwards

[11] Patent Number: 5,310,098

[45] Date of Patent: May 10, 1994

[54] BUSH FOR DIRECTING A STREAM OF MOLTEN METAL INTO A MOLD

[75] Inventor: David J. Edwards, Zola Predosa, Italy

[73] Assignee: Reynolds Wheels S.p.A., Zola Predosa, Italy

[21] Appl. No.: 18,691

[22] Filed: Feb. 17, 1993

[30] Foreign Application Priority Data

Nov. 27, 1992 [EP] European Pat. Off. ..... 92830643.0

[51] Int. Cl.[5] ..... B22D 35/00

[52] U.S. Cl. ..... 222/591; 222/606; 266/236; 164/335

[58] Field of Search ..... 266/236; 222/591, 603, 222/606, 594; 164/337, 335, 437

[56] References Cited

U.S. PATENT DOCUMENTS

| | | | |
|---|---|---|---|
| 1,923,119 | 8/1933 | Sidel | 222/606 |
| 3,435,884 | 4/1969 | Orris et al. | 164/341 |
| 3,502,134 | 3/1970 | Orehoski | 222/603 |
| 3,508,615 | 4/1970 | Evanston | 164/133 |
| 3,529,753 | 9/1970 | Mack | 222/464 |
| 3,672,440 | 6/1972 | Miura et al. | 164/312 |
| 3,685,572 | 8/1972 | Carver et al. | 164/312 |
| 4,429,816 | 2/1984 | Thrower | 222/603 |
| 5,174,360 | 12/1992 | Barbe | 222/603 |

FOREIGN PATENT DOCUMENTS

| | | |
|---|---|---|
| 1156942 | 11/1963 | Fed. Rep. of Germany . |
| 2051760 | 5/1971 | Fed. Rep. of Germany . |

*Primary Examiner*—Scott Kastler
*Attorney, Agent, or Firm*—Darby & Darby

[57] ABSTRACT

Molten metal is either poured or injected into the cavity of a permanent mold by way of a bush which comprises a metal sleeve, anchored to the mold itself, a first tubular element of ceramic material lodged internally of the sleeve, and a second tubular element, also ceramic, coaxial with the first. The stream of metal passes from a feeder into the inlet end of the bush, through the first and then the second ceramic element, and enters the cavity ultimately from an outlet end consisting of a metal annular element connected in a precise and effectively fluid-tight fit with the corresponding end of the second tubular element.

12 Claims, 2 Drawing Sheets

BUSH FOR DIRECTING A STREAM OF MOLTEN METAL INTO A MOLD

BACKGROUND OF THE INVENTION

The present invention relates to a bush through which to direct a stream of molten metal into a mold, by pouring or injection.

In particular, the bush disclosed is advantageously suitable for use in directing a flow of castable alloy, for example aluminium alloy in the liquid state, into a permanent mold fashioned typically from steel.

Conventional bushes employed for the purpose in question appear essentially as a tubular element, fashioned generally in nickel-chromium cast iron or special steel. One end of such an element connects with the interior of a mold, and the remaining end with an item of equipment from which the stream of molten metal or metal alloy flows into the mold, either freely or pressurized to a greater or lesser degree, according to the casting technique adopted. A bush of this type is usually encircled at least in part by a heating element, typically comprising an electrical resistance, of which the function is to generate thermal energy in such a way that the molten metal can be kept heated and maintained in a fluid state when effectively occupying the bush, i.e. throughout the step in which it is poured or injected into the mold.

In the case of the conventional type of bush thus outlined, the need to supply abundant quantities of heat stems from the fact that the heat held in the molten metal passing through the bush is dissipated in an unwarranted and excessive manner, causing the metal itself to cool to a certain extent. Moreover, it is inevitable that heat will be transmitted to the bush substantially in continuous fashion, even where the resistance is activated intermittently, as the active generating periods ultimately become longer in duration and progressively more frequent. Thus, despite the provision of the heating element to the end of reducing the frequency with which the metal solidifies, causing a blockage of the bush, it happens in molding equipment using conventional bushes that the heat applied to the molten metal tends to be generated at temperatures higher than effectively necessary, resulting in wasted energy and high costs. In addition, the bushes themselves are somewhat costly, prone to wear in a relatively short space of time, and need replacing at notably frequent intervals, signifying repeated and costly stoppages in operation of the molding equipment. A further drawback, by no means unimportant, stems from the use of special metals and their limited workability post-solidification; in effect, the conventional type of bush must be secured to the relative molding equipment using complex clamping mechanisms which are laborious to fit and remove. Accordingly, the object of the present invention is to overcome the aforementioned drawbacks through the adoption of a pouring or injection bush capable of affording notable energy savings and ensuring significantly increased output from the molding equipment, of which the durability is distinctly greater than that of conventional bushes and the design such as to allow fitment to and removal from a mold in an extremely swift and simple manner.

SUMMARY OF THE INVENTION

The stated object is realized in a bush according to the present invention. The bush in questiion, which is of the type serving to direct a stream of molten metal into a permanent mold, comprises a metal sleeve secured to the mold, at least a first tubular element fashioned from a ceramic material and accommodated at least in part internally of the metal sleeve, of which one end is placed in communication with a feeder from which the molten metal is supplied to the mold and the remaining end with the cavity of the mold, and a metal annular element positioned adjacent to and substantially in fluid-tight association with the end of the first tubular element directed toward the mold cavity.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
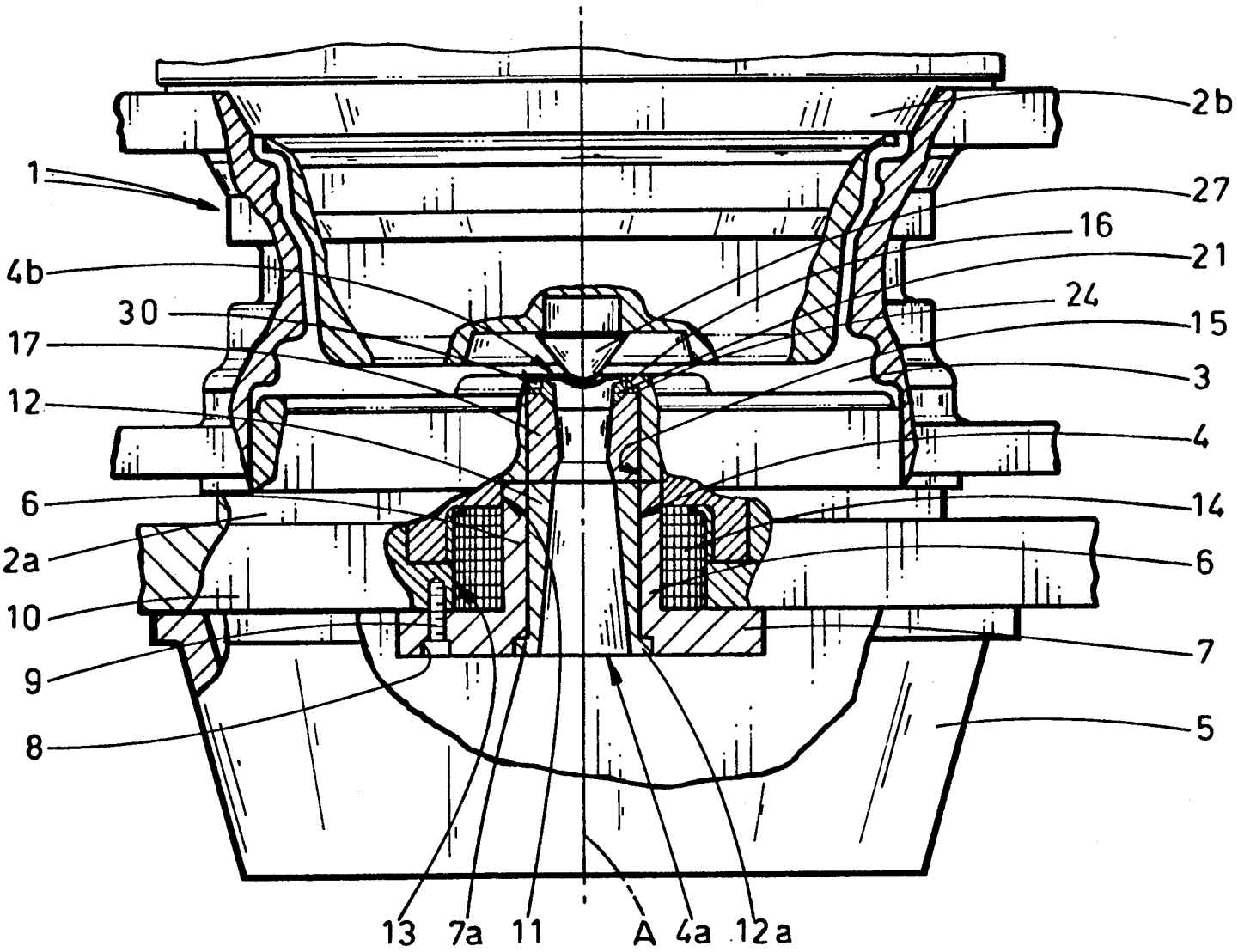
FIG. 1 illustrates a mold, shown in side elevation with certain parts seen in section better to reveal others, and fitted with the injection or pouring bush according to the present invention.

With reference initially to FIG. 1 of the drawings, 1 denotes a mold, in its entirety, of the type used in casting metal items (not illustrated), for example using an alloy that is melted and injected into the mold 1. To this end, the mold 1 affords an internal cavity, denoted 3, which is filled with the molten metal and determines the shape of the casting.

Figure 2:
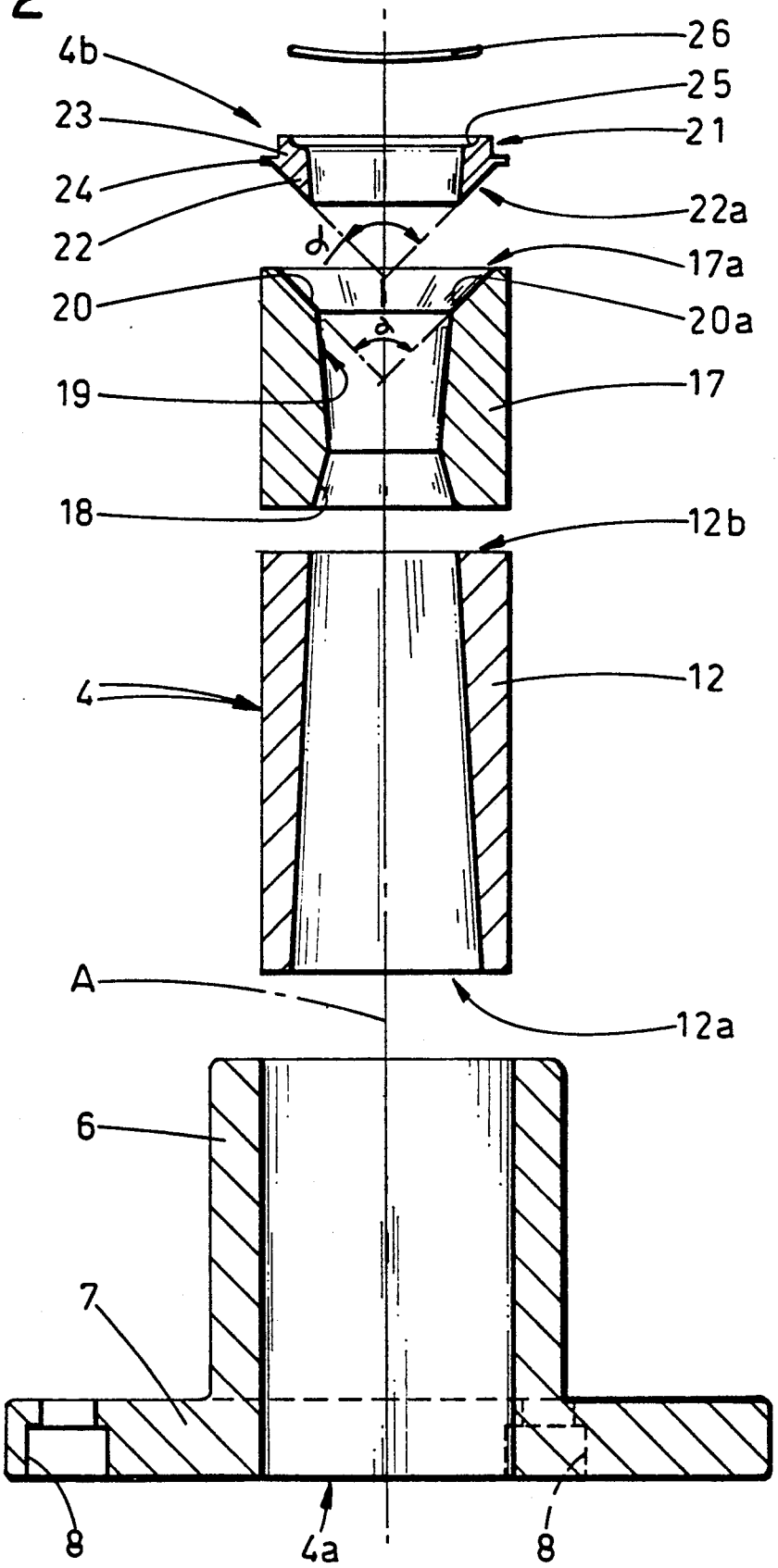
FIG. 2 illustrates the bush of FIG. 1 in an exploded elevation.

4 denotes a pouring or injection bush assembly, referred to simply as a bush in the specification, of which the axis A is indicated in both FIG. 1 and FIG. 2 so as to provide a clear illustration of the coaxial association between the various elements making up the assembly.

FIG. 1 shows the bush 4 inserted into the bottom or moving die 2*a* of the mold 1, though the selfsame bush might equally well be associated with the top die 2*b* in such a way as to function as a pourer, identical in embodiment to the injection bush but operating in the context of other casting methods using gravity feed.

The bush 4 is composed of a plurality of elements, as will emerge in due course, and disposed with one end, the inlet 4*a*, offered in conventional manner to a feeder illustrated schematically as a tank 5, generally pressurized, from which the molten metal is directed forcibly into the bush 4. The remaining end 4*b* of the bush 4 communicates with the mold cavity 3, and affords the means by which the molten metal or alloy drawn from the tank 5 is passed into the cavity, likewise in conventional manner.

The bush 4 comprises a sleeve 6 embodied in steel, of which one end is connected by way of a flange 7, affording holes 8 for respective screws 9, to a corresponding wall 10 of the mold 1; typically, the wall in question will be that of the bottom or moving die 2*a* as in the example of FIG. 1.

The steel sleeve 6 is accommodated coaxially, and with its flanged end in abutment, in a seating 11 afforded by the bottom die 2*a*, and serves in turn to accommodate a first tubular element 12 fashioned in ceramic material. The radially outermost surface of the first tubular element 12 is of substantially cylindrical shape and breasted in firm contact with the internal cylindrical surface of the sleeve 6; the two surfaces might be interfaced with a film of adhesive, preferably a thermosetting glue.

The radially innermost surface of the first tubular element 12 is substantially frustoconical in shape, the greater base of the cone frustum substantially occupying the same plane as the exposed face of the flange 7, as discernible from FIG. 2. Moreover, the end 12*a* of the first tubular element 12 coinciding with the flange 7 might be provided with an annular lip seated in a matching annular undercut 7*a* formed directly in the sleeve 6, as in FIG. 1.

13 denotes an annular recess coaxially encircling at least an intermediate portion of the seating 11 afforded by the bottom die 2*a* of the mold 1, which serves to accommodate heating means 14 consisting in an electrical resistance.

The seating 11 connects with the mold cavity 3 by way of a bore 15, likewise afforded by the bottom die 2*a* and disposed coaxial with the sleeve 6. The bore 15 is of diameter substantially identical to the internal diameter of the sleeve 6, and disposed with its outlet end positioned immediately below the cavity 3, partly occluded by an annular lip 16 projecting radially inward toward the axis A of the bush.

In the example of the drawings, which illustrate one possible embodiment of the present invention, the bush 4 additionally comprises a second tubular element 17, likewise fashioned in ceramic material, which is accommodated coaxially and substantially to a fluid-tight fit by the bore 15. As discernible from FIG. 2, the radially outermost surface of the second tubular element 17 is cylindrical in shape, whereas the radially innermost surface appears as a succession of three frustoconical portions, paired one with the next, respectively denoted 18, 19 and 20 proceeding from the end nearest the sleeve 6 to the end 17*a* nearest the cavity 3. The positioning of the first frustoconical portion 18 is such that its greater base coincides substantially with the lesser base of the internal frustoconical profile exhibited by the first tubular element 12, and its lesser base lies within the bore 15, hence nearer to the annular lip 16. In the case of the second frustoconical portion 19, the lesser base coincides with the lesser base of the first portion 18 and the greater base is disposed a short distance from the annular lip 16, whilst in the case of the third frustoconical portion 20, the lesser base coincides with the greater base of the second portion 19 and the greater base is disposed directly adjacent to the annular lip 16. Again, it will be appreciated that the geometry of the internal surfaces of the second tubular element 17, as illustrated in the drawings, is proposed by way of example and implies no limitation.

As discernible from FIG. 2, the angle denoted "$\alpha$" represents the vertex of the reference cone adopted for the third frustoconical portion 20, of which the value, typically between 60° and 120°, will be selected to satisfy the requirement of enabling a close fit between the respective conical surface, denoted 20*a*, and an annular element denoted 21 also forming part of the bush; in a preferred but in no sense exclusive embodiment of the invention, the angle in question will be 84° or thereabouts. Thus, the conical surface 20*a* forms an angle of $\alpha/2$ with the axis A of the bush 4, that is to say, 42°. The annular element 21 is fashioned from a special steel or other comparable material, and occupies a position internally of the bore 15. More exactly, the annular element 21 is disposed coaxial with the bore 15, and comprises a lower portion 22 compassed laterally by a frustoconical surface 22*a* subtending an angle identical to the angle $\alpha$ mentioned above, which can therefore be breasted with the conical surface 20*a* afforded by the relative portion 20 of the second tubular element 17 when the bush 4 is assembled and fitted to the mold 1, as in FIG. 1. Other parts of the annular element 21 are an upper portion 23 of substantially cylindrical shape, and an annular lip 24, integral with and encircling the join between the lower and upper portions 22 and 23, which registers against the annular lip 16 of the bore 15, as illustrated in FIG. 1.

The surface of the annular element 21 positioned uppermost affords an annular seating 25 destined to accommodate the rim of a circular filter element 26 disposed coaxial with the seating 11 and bore 15 occupied by the bush. With the mold 1 closed, i.e. with the bottom or moving die 2*a* directed upward and into contact with the top die 2*b*, the filter element 26 is held forcibly against the annular element 21 by the bottom end of a vertical pin 27 carried by the top die 2*b* (as illustrated in FIG. 1, though the same function might be performed by a projection incorporated directly into the top die), disposed coaxial with the seating 11 and bore 15 occupied by the bush, and with the impinging bottom end occupying the mold cavity 3.

The operation of the bush 4 will now be described, naturally enough with reference to FIG. 1, in which the bottom or moving die 2*a* is equipped with an annular locating boss 30 at the end of the bore 15 directed toward the mold cavity 3.

To fit the bush 4 to the mold 1, it suffices to insert the component parts into the bore 15 in the appropriate sequence, i.e. the annular element 21, the second tubular element 17, and finally the sleeve 6 containing the first tubular element 12. The flange 7 of the sleeve 6 can now be made secure to the mold 1 with the screws 9, and the bush 4 connected to the feeder 5 by conventional means. It will be observed that the adoption of a ceramic material for the tubular elements 12 and 17, that is to say, a relatively inexpensive material, easy to work and considerably more durable than the materials used in the manufacture of conventional bushes, brings the additional advantage that the sleeve 6 and flange 7 can be fashioned from a steel of ordinary composition, and the flange secured to the mold 1 utilizing swiftly and easily inserted screws 9.

It will also be appreciated that the second tubular element 17, on which the process of wear is more rapid during normal use than on the first tubular element 12, can be replaced with ease by removing the sleeve 6 momentarily, without needing to renew the entire bush 4 when only the part nearest to the mold has become worn, as occurs in conventional equipment. Once the first tubular element 12 begins to show signs of excessive wear also, it is removed from the mold 1 together with the metal sleeve 6 and replaced with a new element, in a new sleeve. A simple press operation will suffice to extract the worn tubular element 12 from the used sleeve 6, whereupon the sleeve can be reused with a new first tubular element 12 pressed in.

Advantageously, with the annular element 21 and the corresponding third frustoconical portion 20 of the second tubular element 17 joined mutually by way of breasted conical surfaces 22*a* and 20*a*, it becomes possible to prevent molten metal from penetrating between the two components in the course of casting operations and causing damage in particular to the second tubular element 17. At high temperatures, in effect, the expansion of the steel annular element 21 will be greater than that of the ceramic tubular element 17, with the result that a substantially perfect seal is established between the two mating surfaces.

The range of reference angles indicated for "α" comprises the values best able, given the different bush geometries available, to guarantee an optimum and constantly maintained hermetic seal between the mating surfaces of the annular element 21 and the respective frustoconical portion 20 of the second tubular element 17; in addition, these same values will protect the mechanical components in question, that is to say the second tubular element 17 and the annular element 21, from damage occasioned by small sliding movements of the respective conical surfaces one in relation to the other, resulting from thermal expansion. The preferred value of "α" as illustrated in the accompanying drawings is 84°. With the two tubular elements 12 and 17 embodied in ceramic material, characterized by a low conduction of heat, the heating means 14 can be activated on an intermittent basis without any adverse effects; in particular, heat can be generated according to a periodic cycle whereby, in contrast to conventional solutions, the power-on intervals will decrease progressively in duration and become less frequent, thus bringing notable economies in terms of energy. Finally, in an alternative embodiment of the bush not illustrated in the accompanying drawings, the two tubular elements 12 and 17 might be embodied as one, fashioned from a single piece of the selected ceramic material.

What is claimed is:

1. A bush for directing a stream of molten metal into a mold, comprising:

(a) a metal sleeve secured to the mold;

(b) a first ceramic tubular element disposed within said metal sleeve, said first tubular element having an outer surface of cylindrical shape and an inner surface of frustoconical shape;

(c) a second ceramic tubular element disposed adjacent to said first tubular element, said second tubular element having an outer surface of cylindrical shape and an inner surface having at least three frustoconical shaped portions;

(d) a metal annular element disposed adjacent to said second tubular element such that said second tubular element is disposed between said first tubular element and said annular element, said annular element having an outer surface, a portion of said annular element outer surface having a frustoconical shape, one of said frustoconical shaped portions of said second tubular element mating with said frustoconical outer surface of said annular element to form a seal.

2. A bush as claimed in claim 1, wherein said mating frustoconical surface between said tubular element and said annular element corresponds to a reference cone of which the angle at the vertex is between 60° and 120°.

3. A bush as claimed in claim 2, wherein said reference cone angle is approximately 84°.

4. A bush as claimed in claim 1, wherein the metal sleeve and the first tubular element are connected to one another with an interfacing layer of adhesive material.

5. A bush as claimed in claim 1, wherein said inner surface of said first tubular element having a substantially frustoconical shape disposed with the greater base end substantially occupying a plane occupied by a flat end surface of the metal sleeve.

6. A bush as claimed in claim 1, wherein the inner surface of the second tubular element comprises the three frustoconical shapes being successively adjacent to one another along the axial direction of the bush.

7. A bush as claimed in claim 5, wherein said inner surface of said second tubular element having a first frustoconical portion whose greater base is adjacent to the lesser base of the inner surface of said first tubular element.

8. A bush as claimed in claim 7, wherein said inner surface of said second tubular element having a second frustoconical portion whose lesser base is adjacent to the lesser base of the first frustoconical portion.

9. A bush as claimed in claim 8, wherein said inner surface of said second tubular element having a third frustoconical portion whose lesser base is adjacent to the greater base of the second frustoconical portion.

10. A bush as claimed in claim 9, wherein said third frustoconical portion mates with said frustoconical outer surface of said annular element.

11. A bush as claimed in claim 1, wherein said first tubular element is disposed adjacent to a feeder source of molten metal.

12. A bush as claimed in claim 11, wherein said annular element is disposed adjacent to a mold cavity.

* * * * *